US010246878B2

(12) United States Patent
Andersson

(10) Patent No.: US 10,246,878 B2
(45) Date of Patent: Apr. 2, 2019

(54) STACKABLE WALL SPACER FOR SUPPORTING REINFORCEMENT IN CONCRETE CONSTRUCTIONS

(71) Applicant: Innovativ Plast i Vaest AB, Goeteborg (SE)

(72) Inventor: Stefan Andersson, Goeteborg (SE)

(73) Assignee: Innovativ Plast i Vaest AB, Goeteborg (SE)

( * ) Notice: Subject to any disclaimer, the term of this patent is extended or adjusted under 35 U.S.C. 154(b) by 0 days.

(21) Appl. No.: 15/736,100

(22) PCT Filed: Jul. 6, 2016

(86) PCT No.: PCT/SE2016/050692
§ 371 (c)(1),
(2) Date: Dec. 13, 2017

(87) PCT Pub. No.: WO2017/007415
PCT Pub. Date: Jan. 12, 2017

(65) Prior Publication Data

US 2018/0163404 A1 Jun. 14, 2018

(30) Foreign Application Priority Data

Jul. 8, 2015 (SE) ..... 1550996

(51) Int. Cl.
*E04C 5/16* (2006.01)
*E04C 5/18* (2006.01)
*E04C 5/20* (2006.01)

(52) U.S. Cl.
CPC ..... *E04C 5/168* (2013.01); *E04C 5/18* (2013.01); *E04C 5/20* (2013.01); *E04C 5/203* (2013.01)

(58) Field of Classification Search
CPC . E04C 5/168; E04C 5/203; E04C 5/18; E04C 5/20
(Continued)

(56) References Cited

U.S. PATENT DOCUMENTS 3,255,565 A * 6/1966 Menzel ..... E04C 5/206 249/30
3,387,423 A * 6/1968 Andersen ..... E04C 5/168 52/678
(Continued)

FOREIGN PATENT DOCUMENTS

AU 2006100538 A4 7/2006
DE 7408515 U 7/1974
(Continued)

OTHER PUBLICATIONS

International Searching Authority, International Search Report and Written Opinion for International Application No. PCT/SE2016/050692, dated Oct. 10, 2016, Swedish Patent and Registration Office, Sweden.
(Continued)

*Primary Examiner* — Joshua K Ihezie
(74) *Attorney, Agent, or Firm* — Alston & Bird LLP

(57) ABSTRACT

Stackable wall spacer adapted for automated distribution using a feeder device and adapted to support a reinforcement grid, where the wall spacer comprises a plurality of leg sections each having a lower foot adapted to be placed on a mold surface for the concrete, where a plurality of wall spacers can be stacked in each other with the feet of one wall spacer extending into corresponding voids of a subsequent wall spacer, where the side wall of a leg section is parallel with the side wall of a leg section of a subsequent wall spacer. The advantage of the invention is that the wall spacers can be stacked in a space saving manner in each other, which allows a cost-efficient storage and transporta-
(Continued)

tion of wall spacers. The invention further allows for wall spacers that can be distributed by using a hand-held or automatic feeder device. Further, a reinforcement grid can be supported by a wall spacer regardless of the position of the spacer.

16 Claims, 5 Drawing Sheets

(58) Field of Classification Search
USPC ..... 52/687, 677, 346.01, 346.03, 346.04
See application file for complete search history.

(56) References Cited

U.S. PATENT DOCUMENTS 3,830,032 A * 8/1974 Robb ..... E04C 5/206 52/687
4,060,954 A * 12/1977 Liuzza ..... E04C 5/168 52/169.1
4,498,270 A * 2/1985 Ilukowicz ..... E04C 5/20 52/685
4,702,048 A 10/1987 Millman
4,835,933 A * 6/1989 Yung ..... E04C 5/168 248/74.4
4,942,714 A 7/1990 Langley, Jr. et al.
6,089,522 A 7/2000 Haslem et al.
7,451,580 B2 * 11/2008 Kelly ..... E04C 5/20 52/637
8,028,490 B2 * 10/2011 Kelly ..... E04C 5/20 52/637
2004/0098942 A1 5/2004 Lee et al.
2004/0261352 A1 12/2004 Bennett et al.
2005/0005564 A1 1/2005 Bennett et al.
2007/0186504 A1 * 8/2007 Gavin ..... E04C 5/168 52/677
2007/0193189 A1 * 8/2007 Bennett ..... E04C 5/168 52/677
2008/0028718 A1 * 2/2008 Erickson ..... E04C 5/206 52/687
2015/0218816 A1 * 8/2015 Andersson ..... E04C 5/20 52/686

FOREIGN PATENT DOCUMENTS

DE 2809430 A1 9/1979
DE 2821078 A1 11/1979
DE 4218573 C1 10/1993
DE 202016102065 U1 6/2016
WO WO 2014/042577 A1 3/2014

OTHER PUBLICATIONS

International Preliminary Examining Authority, International Preliminary Report on Patentability for International Application No. PCT/SE2016/050692, dated Jun. 30, 2017, Swedish Patent and Registration Office, Sweden.

* cited by examiner

STACKABLE WALL SPACER FOR SUPPORTING REINFORCEMENT IN CONCRETE CONSTRUCTIONS

CROSS REFERENCE TO RELATED APPLICATIONS

This application is a National Stage Application, filed under 35 U.S.C. 371, of International Application No. PCT/SE2016/050692, filed Jul. 6, 2016, which claims priority to Swedish Application No. 1550996-1, filed Jul. 8, 2015; the contents of both of which are hereby incorporated by reference in their entireties.

BACKGROUND

Related Field

The present invention relates to a stackable wall spacer adapted to be used for supporting reinforcement grids in concrete constructions. The stackable spacer may be adapted for automated distribution using a feeder device. The size and shape of the spacer is such that it will give reliable support to the reinforcement grid even if the spacers are placed randomly on the mould or form surface. The spacers can be distributed manually, by the use of a hand-held feeder device or by the use of a semi-automatic or automatic feeder device. Due to the fact that the positioning of the spacers is not critical, a cost-effective spacer is provided.

Description of Related Art

Concrete constructions are normally provided with some kind of reinforcement to increase the strength and to prevent cracking. The reinforcement can be single reinforcement bars (rebars), reinforcement grids/meshes or different kinds of fibres or other. Most common are reinforcement grids/meshes made from reinforcement bars of steel when larger areas are to be covered. For smaller areas or as a complement to the grids, single reinforcement steel bars are often used.

To achieve the required properties in a construction, the reinforcement is placed at different heights. This height creates a concrete cover around the reinforcement in the finished construction. Reinforcement spacers are used to simplify the work of positioning the reinforcement at the prescribed height and to maintain it there through the process until the concrete has burned. The type of spacer used is influenced from e.g. regulations, demands from the users, the surrounding environment, natural resources or aesthetic opinions.

The concrete cover is defined as the smallest distance between the reinforcement material and the concrete surface of the completed construction. A concrete cover which differs from the requirements can negatively affect the strength and life cycle of a construction. The requirements on a concrete cover can be set by national regulations and may vary depending on type of construction and on the surrounding environment. One purpose of the concrete cover is to prevent moisture to reach the reinforcement steel, in order to avoid the negative effects corrosion has on the construction. Corrosion will, through its expansion, slowly break apart the nearby concrete, which causes more moisture to reach the steel which in turn accelerates the corrosion process. Over time this will weakens the construction strength.

To provide support for the reinforcement, reinforcement spacers are used. These are often made from plastic and are designed to facilitate that the concrete fully embraces the reinforcement and the spacers. Air pockets in the final construction are not desirable and should be avoided. Depending on the shape of the spacer, it must be provided with some kind of apertures in order to provide escape ways for air to disappear when concrete is poured upon them.

Reinforcement spacers are made from different materials. Most common are spacers made from plastic, but steel, concrete and other materials are also used. Plastic spacers have several advantages compared to other materials, such as ease of handling, low weight and generally low price, the manufacturing process is fast and spacers can easily be formed to a desired shape. Concrete spacers can be used in most constructions. However, the material makes them heavy and the design makes them more complicated to work with. They are primarily used when plastic is not allowed. Steel spacers are primarily used as spacers inside constructions, e.g. between two layers of reinforcement grids. Steel spacers are seldom used as an outer spacer closest to the outer concrete surface as this may cause corrosion problems.

Depending on the field of application, reinforcement spacers are divided into two main groups, foundation spacers and wall spacers. Foundation spacers are primarily used for positioning reinforcement in foundations/ground plates, while wall spacers are primarily used for positioning reinforcement in walls, floors, joists and ceilings. The main difference is the type of underlying surfaces that they are intended to be used on.

Foundation spacers are designed to be used when the formwork surface is classified as soft and/or uneven, such as EPS (extruded polystyrene), a bedding of coarse sand, gravel, grit or other free-draining material or ground. The bearing surface of the spacer towards the ground has a relatively large area and often a large diameter to aid the spacer to stand stable on the ground and not to dig in to the ground/EPS or to tip over. Since foundation spacers primarily are used for ground plates and foundations, the spacer bearing surface will point downward and will not be visible. Foundation spacers thus have no aesthetic significance. It is important that the base plate area of the foundation spacer is large enough not to punch the underlying surface and that it minimizes the risk of the foundation spacer tipping over.

Wall spacers are often designed with thin legs and/or small feet. The formwork surface is generally hard and even, being a mould, which helps to prevent the spacer to tip over or to cut through the surface. When the formwork is removed, the spacer feet are made visible. At a surface not further processed, these feet will show in the concrete surface, especially if they are large, which is not desirable. Therefore wall spacers are designed with minimal feet and are also nearly always coloured like the surrounding concrete. Low visibility is important.

Wall spacers are divided into different subgroups due to differences in design and the way they are used. One type is referred to as linear spacers. They are long and narrow. They support the reinforcement anywhere on its support area lengthwise and no exact positioning is thus required. Due to their length, up to 2 meters, they shorten the working time of placing the spacers. Another subgroup comprises small individual wall spacers of different designs. The size is most often a few centimeters in each direction, with different shapes that may e.g. be flat or circular. These are all manually fixed to the reinforcement. Another subgroup comprises circular or square grid spacers which are larger than a single mesh in a reinforcement grid. Like linear spacers, no exact positioning of the spacers is required and they are often used within the precast industry. Another subgroup comprises automated disc-shaped "wheel" spacers. They are often used in the precast industry, in fully automated production lines where the spacers are attached to rebars by an automatized mounting device. Also handheld mounting device can be used.

AU 2006100538 describes a linear wall spacer, having small feet adapted for the use as a wall spacer. A specific base segment can be attached to the feet, such that the spacer can be used as a foundation spacer. U.S. Pat. No. 4,942,714 describes a linear wall spacer. US 2005005564 describes a stackable foundation spacer having an upper receiving section for fixedly retaining of a wire mesh or single reinforcement bars.

DE 2821078 describes a circular grid spacer for walls adapted for producing prefabricated modules, where the spacer can be placed randomly on the mould. With a diameter larger than a single square in a reinforcement grid, the spacer will always give support regardless of its position. DE 2809430 also describes a similar wall spacer that can be positioned randomly.

DE 7408515 shows different shapes of disc-shaped "wheel" spacers adapted for automated assembly of spacers on rebars, and also shows how the spacers are mounted to the rebars.

DE 4218573 describes a disc-shaped "wheel" spacer and equipment for automatically attach such spacers on reinforcement bars. Each spacer and the rebar must be in an exact position before any assembling is possible.

U.S. Pat. No. 3,830,032 describes a modular spacer which is adapted to be attached to a reinforcement by hook arms. Two or more spacers can be placed on each other in order to provide spacers of different heights. Feet portions of a spacer can be inserted into corresponding holes of another spacer such that the spacers can be nested together. US 20080028718, U.S. Pat. Nos. 4,060,954 and 6,089,522 also describe modular spacers where two or more parts can be stacked on each other in order to provide spacers with different heights.

All these spacers are transported separately and are only stacked when in use. The stacked parts are further adapted to give a good hold, such that the parts do not separate easily.

There is thus room for an improved wall spacer.

BRIEF SUMMARY

An object of the invention is therefore to provide an improved stackable wall spacer for supporting a reinforcement grid. A further object of the invention is to provide an improved stackable wall spacer which is adapted for automated distribution.

The solution to the problem according to the invention is described in the characterizing part of claim 1 regarding the wall spacer. The other claims contain advantageous embodiments and further developments of the wall spacer.

In a stackable wall spacer adapted to support a reinforcement grid, where the wall spacer comprises a circumferential body section having an upper support surface adapted to support the reinforcement grid, and a plurality of leg sections each having a lower foot adapted to be placed on a mould surface for the concrete, where the outer shape of the circumferential body section is larger than a mesh in the reinforcement grid that is to be supported, the object of the invention is achieved in that each side wall (19) of a leg section (4) is inclined with respect to a vertical direction and that a leg section is provided with a void at an upper portion of a leg section, where the void is adapted to house a leg section of another wall spacer, such that a plurality of wall spacers can be stacked in each other with the feet sections of one wall spacer extending into the corresponding voids of a subsequent wall spacer, such that the side wall of a leg section is parallel with the side wall of a leg section of a subsequent wall spacer.

By this first embodiment of the wall spacer according to the invention, a wall spacer that can be stacked in a space efficient manner is provided. The wall spacer is intended to be used to support reinforcement grids in concrete constructions when producing walls, floors, joists or ceilings using a mould or form. The size of the wall spacer is designed such that the wall spacer will always be able to support a reinforcement grid, i.e. the wall spacer will not be able to pass through the reinforcement grid. The shape of the wall spacer can be selected freely, as long as the outer dimensions of the upper support surface is larger than a mesh of the reinforcement grid in at least one direction. For a circular wall spacer, the diameter of the wall spacer must be larger than the width of a quadratic mesh in the reinforcement grid. For a quadratic wall spacer, a side wall of the wall spacer must be longer than the width of a quadratic mesh in the reinforcement grid. For a wall spacer having another shape, or for a reinforcement grid having rectangular meshes, the smallest width of the wall spacer in any direction must be wider than the smallest dimension of the mesh. In this way, the wall spacer will be able to support the reinforcement grid regardless of the relative position between the wall spacer and the reinforcement grid.

In order to be able to stack the wall spacers in each other with the same orientation, the leg sections must have inclined side walls with respect to a vertical direction and must be provided with a void, such that a leg section of one wall spacer can extend into the void of another wall spacer. When a first wall spacer is stacked with a second wall spacer, the side wall of a leg section of the first wall spacer will be parallel with a side wall of a corresponding leg section of the second wall spacer. Depending on the height of a wall spacer, i.e. on the length of a leg section, the side wall of a leg section of the first wall spacer will also be parallel with a side wall of a third stacked wall spacer. The inclination of a side wall of a leg section is here compared to a vertical direction. The wall spacer is intended to be used on horizontal surfaces, and the vertical direction is a direction perpendicular to the horizontal plane when the wall spacer is used.

The inclination of a side wall of a leg section is e.g. adapted to the height of the wall spacer and the thickness of a side wall, and is preferably in the range between 3 to 25 degrees. With a smaller inclination, several wall spacers cannot be stacked in each other, and with a greater inclination, the stability of the wall spacer and the strength of the leg sections are not optimal.

It is important that at least a part of a leg section extends into the void of a subsequent wall spacer, such that the side walls of the leg sections are parallel. In this way, the orientation of the wall spacers will be well defined which makes a stack of wall spacers easy to handle. A leg section of one wall spacer preferably extends into the void of a subsequent wall spacer with at least 30% of the height of the wall spacer, and may extend into the void of a subsequent wall spacer with at least 50% or more of the height, depending on the height of a wall spacer. The height of a wall spacer is the distance between the underside of a foot to the upper support surface.

Due to the size and shape of a wall spacer, the wall spacers can easily be embraced by concrete and they can be positioned randomly and can still support the reinforcement grid. Since the positioning of the spacers is not critical, the distribution of spacers can be made in a time-saving manner e.g. using a feeder device. Further, the wall spacers must not be attached to a reinforcement grid, which also save time. The shape of the wall spacer allows the spacers to be stacked in each other, which saves space during transportation and storage. Both manual and automated handling of the spacers is also facilitated.

In an advantageous development of the invention, the wall spacer comprises a central opening which is adapted to be used for an automated distribution of wall spacers. The central opening allows a stack of wall spacers to be inserted onto a hand-held feeder device through the central opening, where the feeder device comprises an elongated body. The wall spacers can be released one by one by operating a release mechanism in the feeder device. The feeder device operates outwards from the body of the feeder device, such that the feeder device holds and supports the wall spacers at a rim of the central opening. The rim of the central opening is preferably interconnected with the body section through a plurality of vertical connection walls. The use of connection walls provides an open wall spacer, which allows concrete to fill and surround the wall spacer.

In an advantageous development of the invention, the body section of the wall spacer comprises an outer side wall extending around the outer circumference of the wall spacer. In this way, the strength and the stability of the wall spacer is improved. The outer side wall is preferably provided with an outwards extending rim, which further improves the stability and the strength of the wall spacer, and by which the number of possible contact positions for the reinforcement grid is increased. The body section may also comprise an inner wall, preferably arranged adjacent the outer side wall. The outer and inner side walls are preferably interconnected by a plurality of vertical reinforcement walls, which connects the outer and inner walls to each other. In this way, the stability of the wall spacer is increased, and the reinforcement walls obviate the need for a bottom between the outer and inner side walls. In this way, the filling of concrete in and around the wall spacer is improved.

In an advantageous development of the invention, the outer shape of the wall spacer is quadratic. By using a symmetric shape, the handling of the wall spacer is simplified.

In an advantageous development of the invention, the outer shape of the wall spacer comprises three parts having a dividing angle of 120 degrees. With such a shape, the stability of the wall spacer is improved. Further, the amount of material required for the wall spacer is reduced.

In an advantageous development of the invention, a leg section is circular and conical. In this way, the leg of one wall spacer will fit inside a corresponding leg of another wall spacer. In this way, a plurality of wall spacers can be stacked where the side walls of corresponding leg sections are parallel. Since each leg extends into a corresponding leg of another wall spacer, all wall spacers will be stacked with the same orientation. This simplifies the transport and storage of the wall spacers, and simplifies the distribution of wall spacers using a feeder device. It is also possible that a leg section comprises at least two perpendicular straight walls. The straight walls are also inclined with respect to a vertical direction, such that a leg section of a wall spacer can extend into a corresponding leg section of another wall spacer when the wall spacers are stacked in each other. The side walls of corresponding leg sections will be parallel and are arranged next to each other, such that the outer side wall of a wall spacer bears on or is very close to the inner side wall of a subsequent wall spacer. If ridges are used to define the vertical spacing of stacked wall spacers, the side walls may not bear on each other completely, but will be very close to each other, and the side walls of some leg sections may bear on each other. The advantage of using ridges is that the wall spacers will not "stick" to each other. This will also be influenced by the inclination angle of the side wall and the side wall thickness.

In an advantageous development of the invention, the wall spacer comprises a plurality of ridges arranged on the outer and/or inner side wall adapted to bear on the upper support surface of another wall spacer when several wall spacers are stacked. In this way, the wall spacers will not stick to each other when they are stacked, such that they can easily be separated one by one when they are distributed by a feeder device. Further, a well-defined vertical interval for the stacked spacers is obtained. A well-defined vertical interval between stacked wall spacers is important, and is preferably between 8-30 mm.

In an advantageous development of the invention, the wall spacer is further provided with a number of upward protruding pins, adapted to prevent a wall spacer from being dispositioned by the concrete when a large quantity of concrete is poured into a mould. With the protruding pins, the wall spacer will stay in the selected position. A recess is preferably arranged in the outer side wall of the body section below a pin, such that the pin can extend into a recess when two wall spacers are stacked in each other.

BRIEF DESCRIPTION OF THE FIGURES

The invention will be described in greater detail in the following, with reference to the embodiments that are shown in the attached drawings, in which.

DETAILED DESCRIPTION OF VARIOUS EMBODIMENTS

The embodiments of the invention with further developments described in the following are to be regarded only as examples and are in no way to limit the scope of the protection provided by the patent claims.

Figure 1:
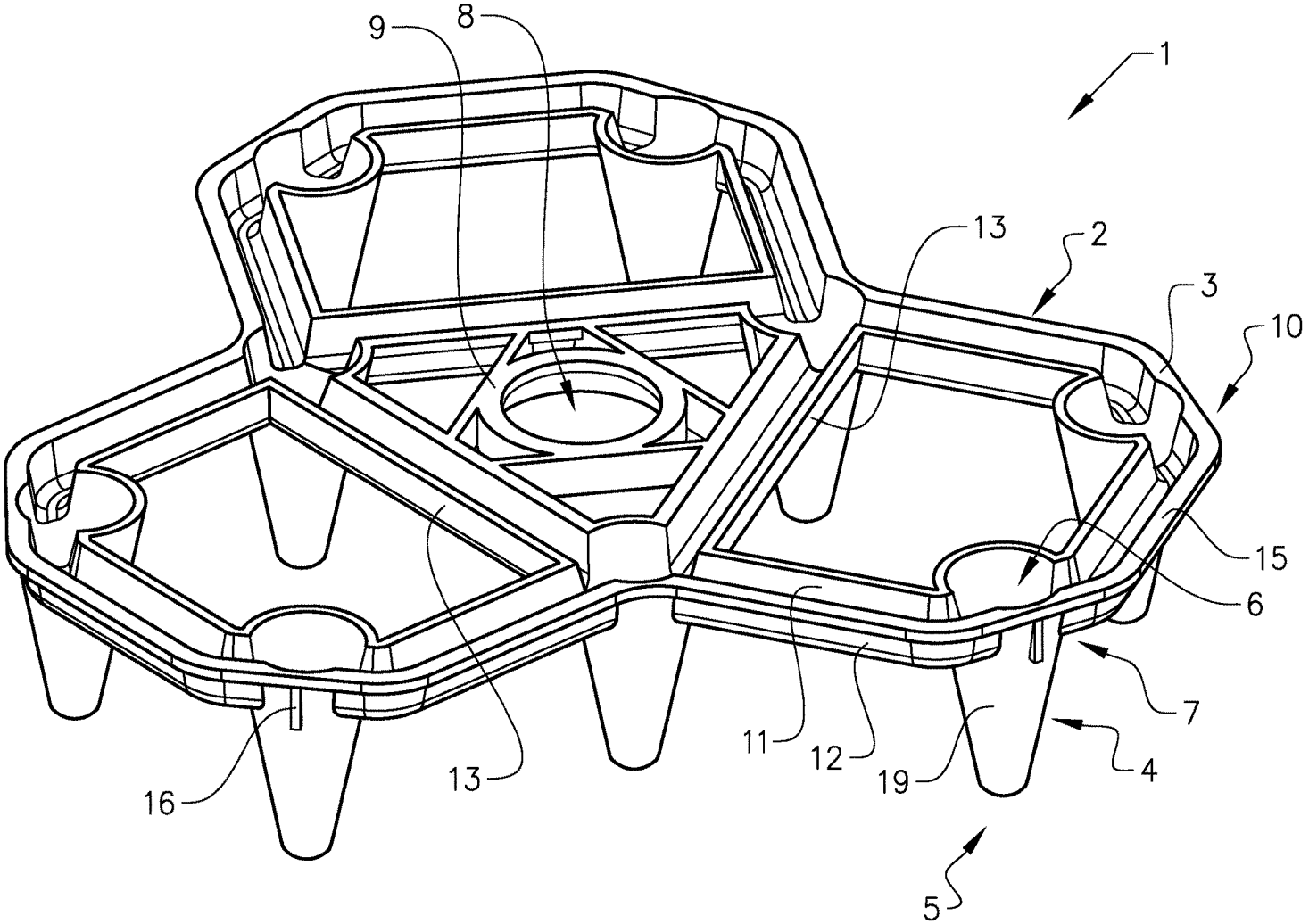
FIG. 1 shows a first embodiment of a wall spacer according to the invention.

FIG. 1 shows a first embodiment of a wall spacer according to the invention adapted to support reinforcement grids. The wall spacer 1 comprises a body section 2 which forms the body of the wall spacer. The body section comprises a plurality of leg sections 4, where each leg section comprises at least one foot 5. A foot is adapted to be placed on the lower surface of a mould or form in which a concrete element is created. A concrete element may be e.g. a wall element, a floor element, a joist or a ceiling element. The concrete element may be either a prefabricated concrete element or may be a concrete element that is built at a building site. This support surface of the mould or form is a rigid, hard surface on which small feet can stand without sinking into the surface. It is also possible to attach wall spacers to a reinforcement grid when a vertical wall is produced between two vertical mould surfaces, in order to provide a predefined distance between the reinforcement grid and the mould surfaces.

The wall spacer further comprises an upper circumferential support surface 3 adapted to support a reinforcement grid in a plurality of positions. The size of the spacer and thus the outer circumference 10 of the upper support surface is such that it is larger than a mesh in the reinforcement grid. In this way, the wall spacer can always support a reinforcement grid, regardless of where the wall spacer is positioned relative the reinforcement grid. The upper support surface is preferably flat, but may also comprise a plurality of protrusive surface elements having their upper surface positioned in the same horizontal plane, such that a reinforcement grid can be supported by the support surfaces.

The body section comprises a plurality of leg sections 4. A leg section is defined as a part of the wall spacer that comprises a foot 5 which is adapted to stand on the support surface with a small foot print. A leg section is provided with inclined side walls 19 such that a leg section of one wall spacer can extend into a leg section of another wall spacer when a plurality of wall spacers are stacked in each other. When a first wall spacer is stacked in a second wall spacer, the inclined side walls of a leg section of the first wall spacer will be parallel with the inclined side walls of a corresponding leg section of the second wall section. A leg section is thus hollow or comprises a void. In one example, a leg section is a conical hollow leg as shown in FIG. 1. A conical shape gives a strong leg with a minimum of material usage. A wall spacer must sometimes withstand a weight of more than 100 kg, since a wall spacer must be able to bear the weight of a reinforcement grid and a worker walking on the reinforcement grid. The circumferential side wall of the conically shaped leg section may be closed or may comprise a cut-away section such that the conical shape is open. An open shape allows concrete to fill the leg and allows air to escape. The wall spacer shown in FIG. 1 has a height of approximately 40 mm. Each leg section is thus approximately 40 mm high, and the leg sections extend out from the body section by approximately 30 mm. The height of a wall spacer is the distance between the underside of a foot to the upper support surface. The circumferential conical side wall of a leg section ends in a foot 5, in order to provide a small footprint. The foot may be pointed or may be provided with a radius. The area of an upper portion 7 of a leg section is always provided with the largest area of a leg section, such that a lower part of a leg section always fits in the upper portion of a leg section. The upper portion 7 of a leg section is integrated with the body section and thus with the outer side wall 12, and with an inner side wall 11 if an inner side wall is used.

Figure 2:
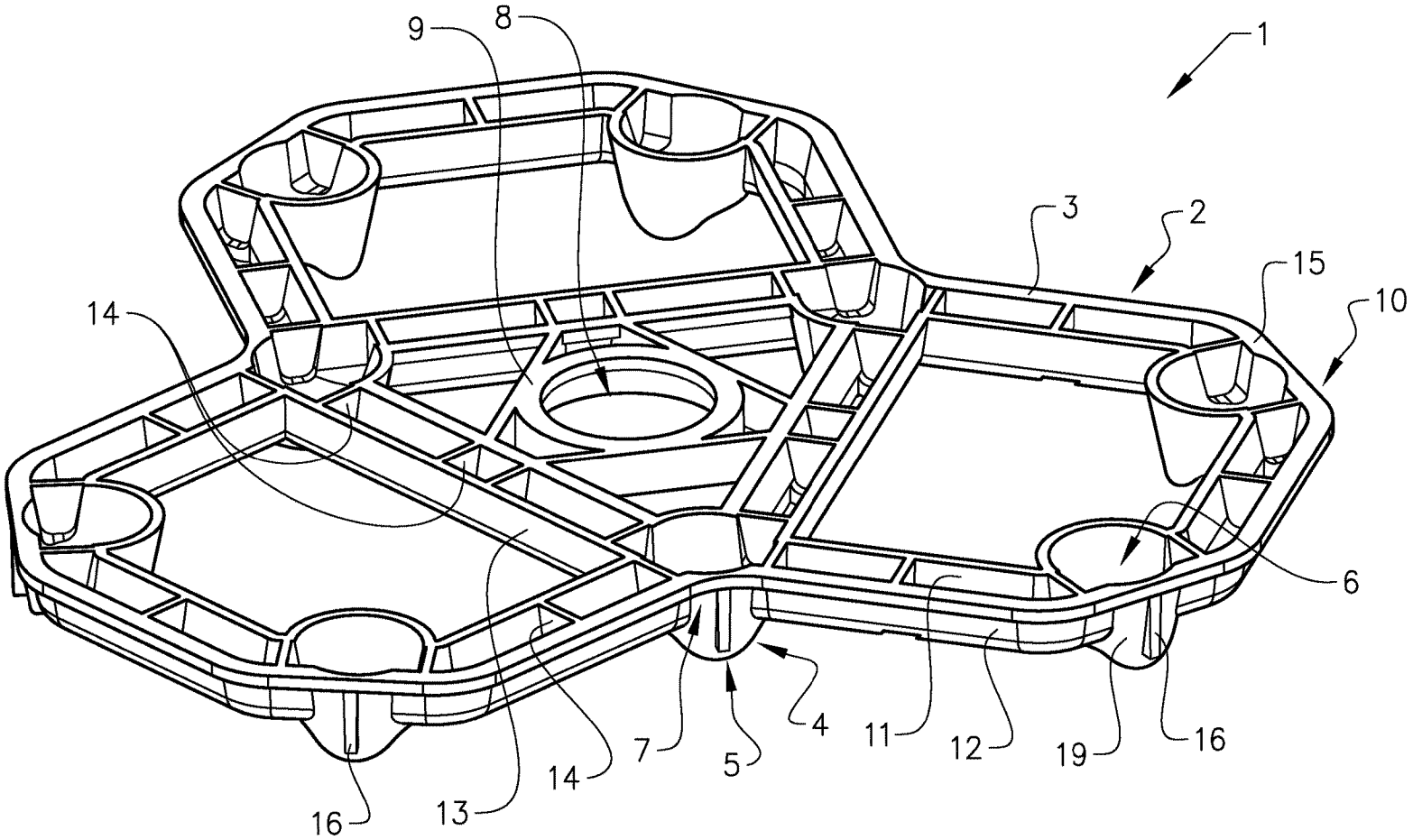
FIG. 2 shows a development of a wall spacer according to the invention.

A further example of a leg section is shown in FIG. 2, where a wall spacer having a height of approximately 15 mm is shown. In this example, a leg section is 15 mm high, with the leg section extending out from the body section by approximately 5 mm. Here, the leg section resembles a truncated cone where the side wall of the leg section is shaped to provide two feet.

A leg section may have different shapes and sizes, but a leg section must always fit inside an upper part of another leg section, such that two wall spacers can be stacked in each other. A leg section may also comprise two straight side walls with an angle between them, e.g. perpendicular walls or walls with an acute or obtuse angle, where the straight walls are inclined with respect to a vertical direction. In this way, a leg section can extend into the void of a leg section of another wall spacer when several wall spacers are stacked, with the side walls of the leg sections being parallel. The side wall of a leg section is inclined with respect to a vertical direction, where the inclination angle is between 3 and 25 degrees.

A leg section may also have other different shapes, such as a semi-circular shape, an inverted pyramid shape, a part conical shape etc., as long as the side walls of the leg section are somewhat inclined such that a leg section of one wall spacer can fit in a corresponding leg section of another wall spacer when the wall spacers are stacked. The side walls 19 of the leg section 4 must be inclined inwards in relation to a vertical axis, such that a conically shaped void is created inside the leg section. An angle of e.g. 11 degrees with relation to a vertical axis 23 is used in the shown examples, but a range between 3 to 25 degrees may be suitable. If the angle is too small, the leg section of a wall spacer will not fit in the void of another leg section in an optimal way. With a larger angle, the stability of a leg section will decrease.

Figure 3:
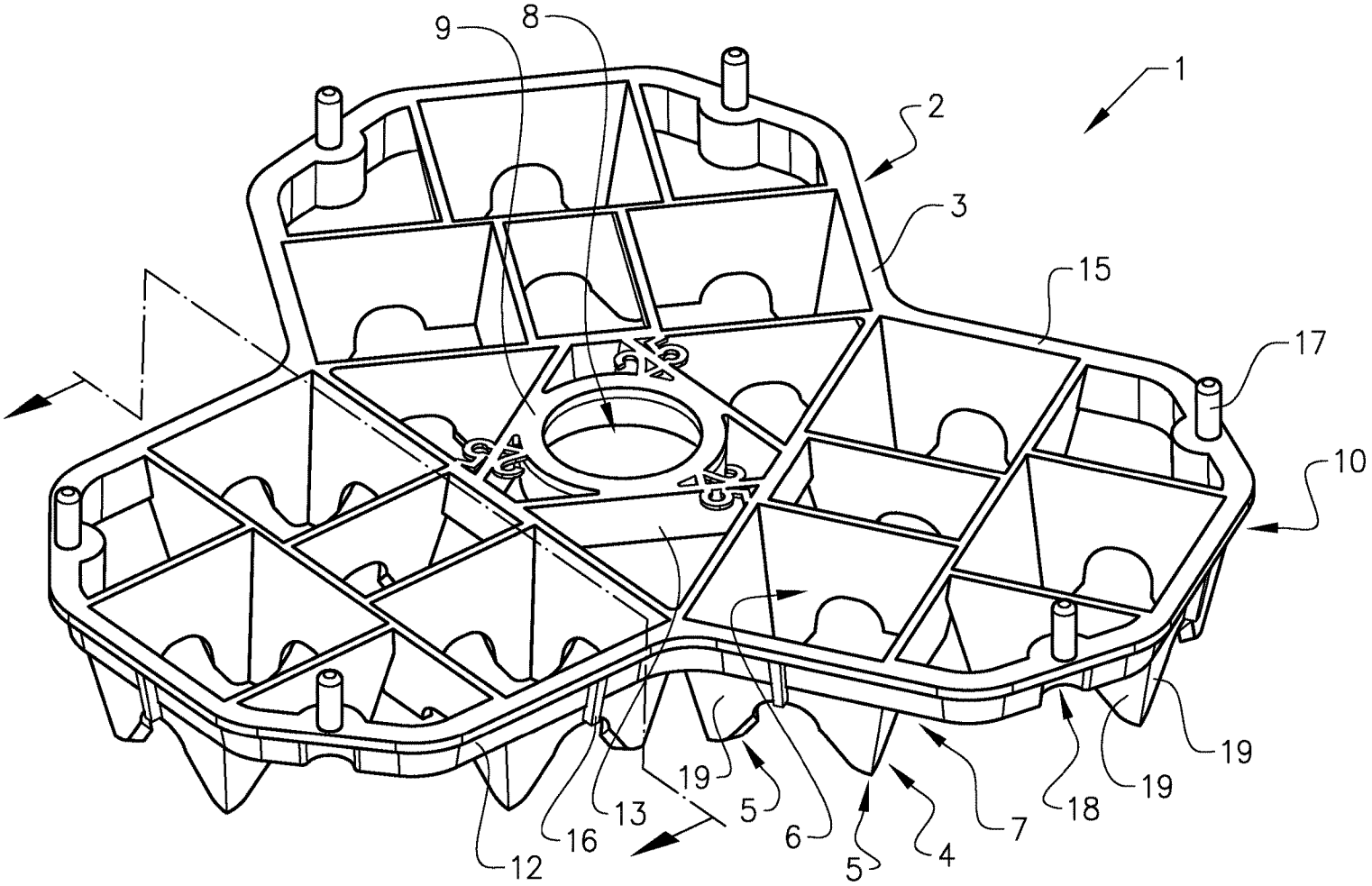
FIG. 3 shows another development of a wall spacer according to the invention.

FIG. 3 shows a further example of a wall spacer according to the invention. In this example, the leg sections 4 are square with inclined side walls 19. In the shown example, the side walls of a leg section are provided with recesses in order to allow concrete to flow through and to allow air to escape. Each lower corner of a leg section is pointed and constitutes a foot 5. Several leg sections are interconnected to each other through the side walls of adjacent leg sections and by the outer side wall 12 and the connection walls 13. In this example, the body section of the wall spacer is only provided with an outer side wall 12, where the outer side wall and the inner rim 9 of the central opening are interconnected by the upper portions of the leg sections and connection walls. It is also possible to provide the portion at the central opening with leg sections. In this way, the inner rim of the central opening will further add to the stability of the upper support surface with the help of the additional feet.

In the shown example, the wall spacer is further provided with a number of upward protruding pins 17. Here, the pins are positioned at the outer rim 15 of the body section. The purpose of the pins is to prevent a wall spacer from being dispositioned by the concrete, when a large quantity of concrete is poured into a mould, especially if the concrete is poured from one side of the mould, e.g. when using concrete that must not be vibrated. With no pins, there is a risk that the concrete may push a wall spacer from the selected position to another position. When vibration tables are used to vibrate the concrete in order to remove air, there may also be a risk that a wall spacer moves to another position due to the vibrations. With the protruding pins, the wall spacer will stay in the selected position. The pin does not add to the defined height of a wall spacer.

A recess 18 is preferably arranged in the outer side wall of the body section below a pin 17. In this way, the pin can extend into a recess when two wall spacers are stacked in each other. The recess allows the pin to be high enough to securely interact with the rebars of a reinforcement grid in a horizontal direction. It is possible to give the pins a height such that the upper surface of a pin bears on the lower surface of the outer rim when two wall spacers are stacked in each other. The pins may in this case replace or complement the ridges 16 in order to provide a defined distance between the wall spacers in a stack of wall spacers.

It is also possible that a leg section comprises a single side wall section, i.e. a part of a larger side wall, having a lower foot. Such a wall spacer will be somewhat weaker than wall spacers having a leg section that is conical or comprises more than one side wall, but may be sufficiently strong for prefabrication elements where workers do not walk on the reinforcement grid.

The body section 2 is provided with an outer rim 15 that extends outwards from the outer side wall 12. The outer rim is in this example part of the upper support surface. The outer circumference 10 of the outer rim thus sets the size and shape of the support surface. The size of the support surface is such that it is larger than a mesh in the reinforcement grid that is to be supported. For a round wall spacer, the outer diameter of the outer rim is thus larger than the mesh size of the reinforcement grid. When the wall spacer has another shape, the outer limit of the outer rim is such that regardless of how the wall spacer is positioned, it will be larger than a mesh of the reinforcement grid. By securing that the wall spacer can always support the reinforcement grid without the spacer passing through a mesh, the wall spacer can be distributed randomly on the mould surface. An exact positioning is thus not required, which saves time. Further, a feeder can be used which distributes spacers semi-automatically or fully automatically, which allows even more time to be saved.

The outer rim will further increase the support area for the reinforcement grid and will also prevent the reinforcement grid to cut through the support surface and to damage the wall spacer. The rim should extend around the complete spacer without interruptions. In one shown example, the body section also comprises an inner side wall 11 arranged adjacent the outer side wall. The outer and inner side walls are interconnected by a plurality of vertical reinforcement walls 14, which connects the outer and inner side walls to each other. In this way, the upper part of the inner side wall will also be part of the upper support surface. The inner side wall will also increase the stability of the wall spacer, and the reinforcement walls obviate the need for a bottom between the outer and inner side walls. In this way, the filling of concrete in and around the wall spacer is improved.

The centre of the wall spacer is provided with a central opening 8. The central opening 8 is preferably arranged symmetrically around a centre axis of the wall spacer. The central opening is adapted to interact with a feeder device adapted to release one wall spacer at the time, e.g. when pressing a handle. The central opening is provided with an inner rim 9 extending inwards towards the centre of the central opening. The inner rim may be provided with a vertical wall in order to stabilize the inner rim. Release means, such as release balls, arranged at the feeder device will bear against the inner rim of the wall spacer. The inner rim will also be comprised in the upper support surface and will help to distribute the load of the reinforcement grid. The inner rim is connected to the outer side wall and the inner side wall by connecting walls 13. The connection walls may also be part of the upper support surface and may also help to distribute the load to the leg sections.

Since the upper support surface is flat and is situated in one plane and does not comprise any holding means for reinforcement bars, the wall spacer is mainly intended for supporting reinforcement grids. It is of course possible to use it for support of other types of suitable reinforcement structures as well, e.g. to bind reinforcement bars to the wall spacer. The wall spacer can be randomly placed and will still support reinforcement grids.

The size and design of the wall spacer allows them to be placed at random positions and still be able to give a good support for a reinforcement grid. There are no regulations that stipulate the required number of spacers needed to support a given reinforcement grid. With the inventive wall spacer, the exact number of wall spacers and the exact position of each spacer are not important, since the reinforcement grid is always supported by each spacer. The size of the upper support surface of the wall spacer is adapted to the size of the meshes in the reinforcement grid that is to be supported.

The outer shape of the wall spacer may have different shapes. A circular or quadratic shape is possible, but in the shown examples, a shape resembling three semi-circular parts having a dividing angle of 120 degrees is used. Other shapes are also possible, but this shape is advantageous in that it provides a plurality of support points for a reinforcement grid. Preferably, the outer circumferential shape of the wall spacer is continuous around the wall spacer, with no parts sticking out from the outer surface in a horizontal direction. In order to improve the strength of the wall spacer, and to provide more support points, the semi-circular parts are interconnected by one or more connection walls. The connection walls may also be provided with one or more leg sections. This helps to stabilize the wall spacer and provides further support surfaces, such that the weight of the reinforcement grid is distributed on more support points.

The wall spacer is preferably provided with ridges 16 adapted to define the spacing in height between two spacers when they are stacked in each other. A ridge is preferably provided at the upper portion 7 of a leg section and extends downwards such that the desired height spacing is obtained. A suitable spacing in height between two wall spacers may be e.g. 12 mm, and is preferably in a range between 8 to 30 mm. The ridges will also facilitate the stacking of spacers. The height of the ridges are such that the bearing surface of a ridge will stand on the upper support surface of another spacer when stacked, which prevents the leg sections of the wall spacers to stick in each other when they are stacked. This makes it easier to part a stack of spacers. The ridges define the spacing in height, i.e. vertical interval, between the spacers. A well-defined vertical interval is advantageous in that it simplifies the feeding of stacked spacers from a feeder device. It is also possible to provide ridges on other positions, e.g. on the outer side of a side wall, in order to define the stacking distance between two spacers.

With a spacing in height of 12 mm between two wall spacers, a leg section of a spacer having a height of 40 mm will extend into the void of another leg section with 70%. A wall spacer having a height of 20 mm will in this case extend into the void of another leg section with 40%.

The wall spacer is mainly adapted to be distributed by a feeder device, even if it possible to distribute them by hand by a user. Since the wall spacers shown in FIGS. 1 to 3 can be placed randomly and must not be positioned exactly, they are time efficient and easy to use. Compared to other wall spacers, the time for distributing such a stackable wall spacer can be reduced considerably by using a handheld feeder device or an automated feeder device.

Figure 4:
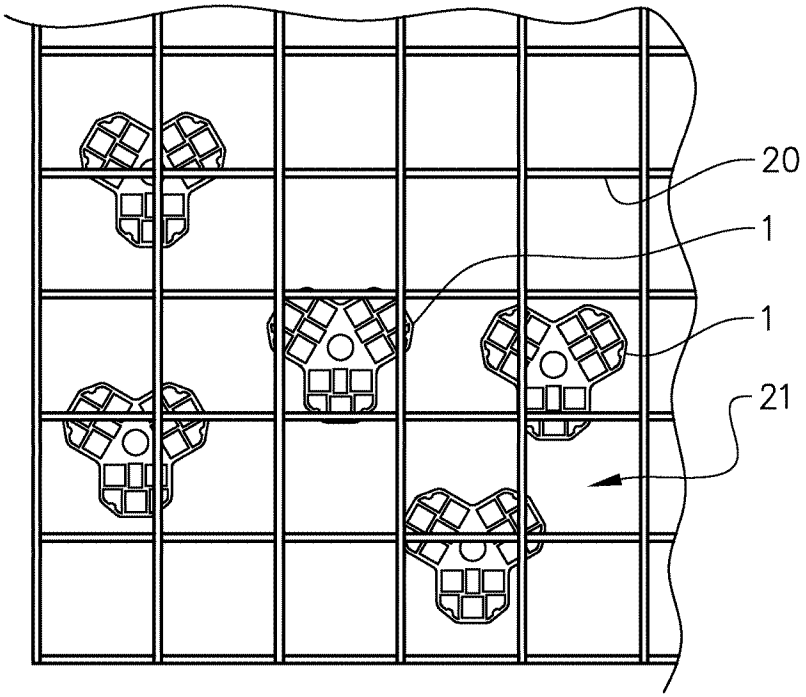
FIG. 4 shows a plurality of wall spacers according to the invention supporting a reinforcement grid.

FIG. 4 shows a plurality of wall spacers supporting a reinforcement grid from above. In this example, the outer shape comprises three parts divided with an angle of 120 degrees. The shape slightly resembles a clover leaf shape. Other shapes are of course also possible, as long as the shape is larger than a mesh in the reinforcement grid that is to be supported. In this example, the wall spacer is intended for a reinforcement grid 20 with a mesh 21 size of 20 cm. The outer shape of the support surface is thus larger than a square of 20*20 cm. In this way, the wall spacer will always be able to support the reinforcement grid, regardless of how the grid is positioned on the spacer. The reinforcement grid will not be able to fall down due to a misaligned spacer. As can be seen in FIG. 4, a wall spacer will always support the reinforcement grid at several support points, regardless of the relationship between the position of a wall spacer and the reinforcement grid.

Figure 5:
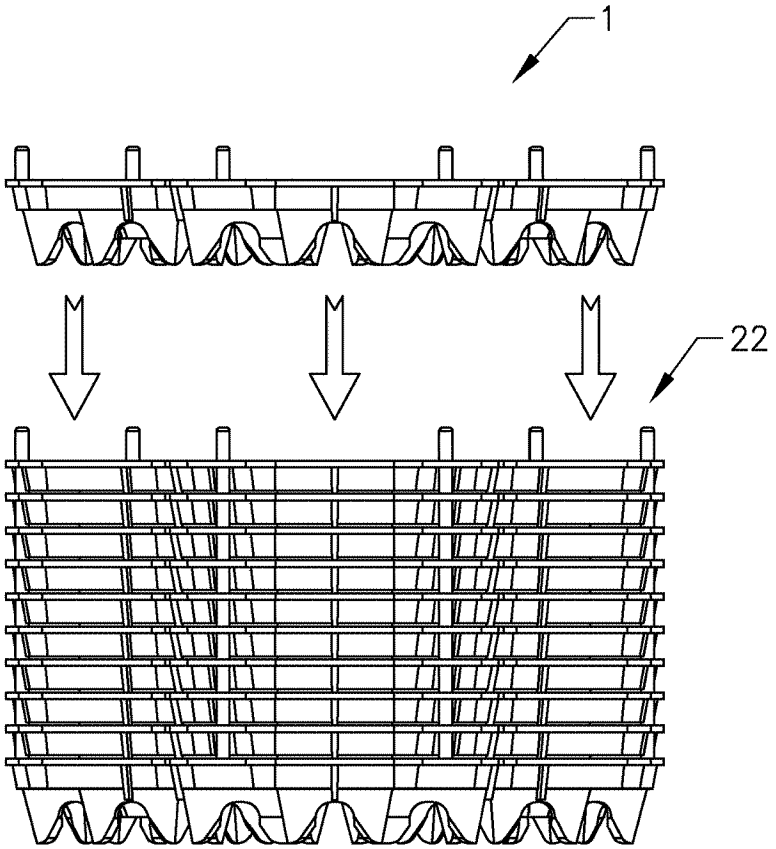
FIG. 5 shows a stack of wall spacers according to the invention.
Figure 6:
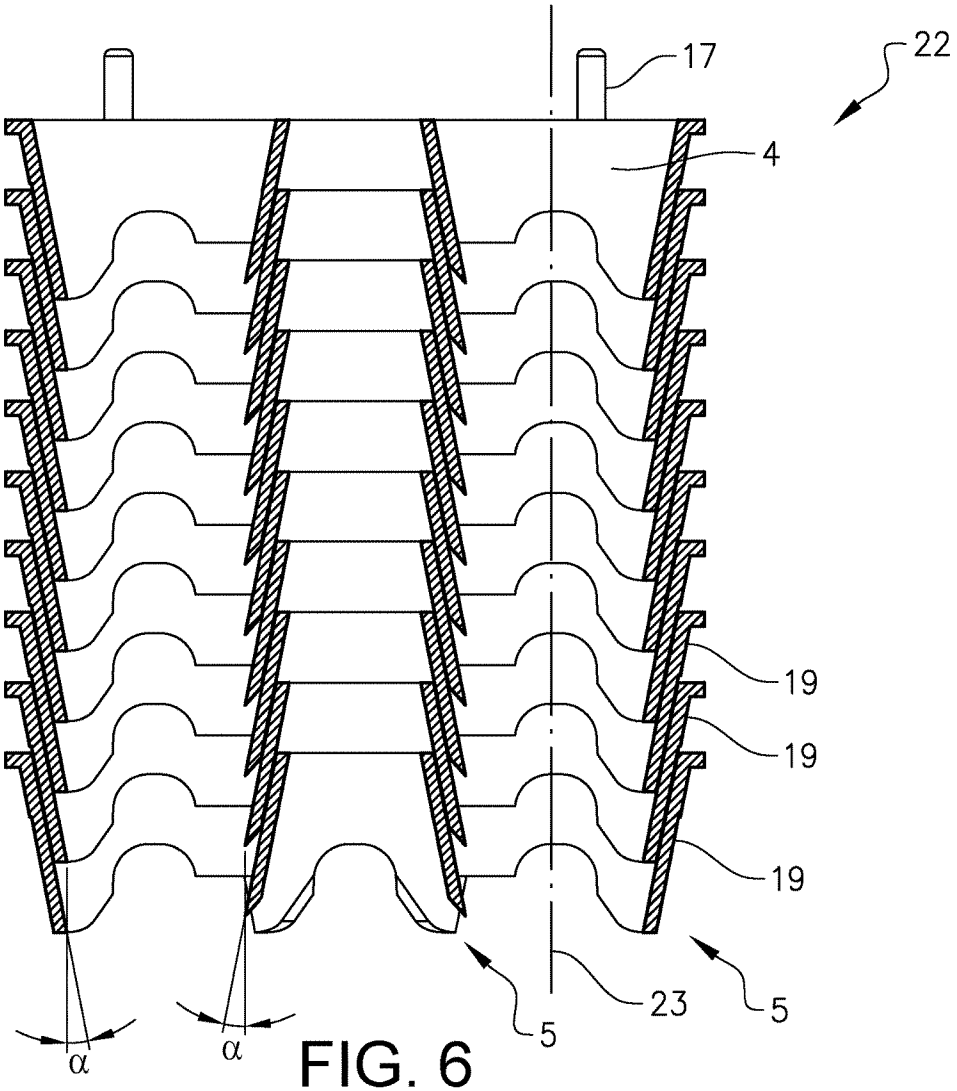
FIG. 6 shows a cross-section of a stack of wall spacers according to the invention.

FIG. 5 shows a stack 22 of wall spacers 1, and FIG. 6 shows a cut view of the stack of wall spacers. As can be seen in the figures, the wall spacers are stacked in each other, such that the side walls 19 of the leg sections 4 are parallel to each other, and such that the outer side wall of a wall spacer is very close to and almost bears on the inner side wall of a subsequent wall spacer. The shown wall spacers uses ridges 16 to define the vertical spacing of the wall spacers in the stack of wall spacers, which means that all side walls of a wall spacer will not bear on all side walls of a subsequent wall spacer. The side wall of a leg section is inclined with respect to a vertical direction 23, where the inclination angle $\alpha$ is between 3 and 25 degrees.

A stacked pile of wall spacers saves space during transportation and storage, and allows further for an efficient distribution of wall spacers with a feeder device. By stacking the wall spacers, the feeder device will be able to carry many wall spacers at the same time, which reduces both the loading time of a stack of wall spacers and the distribution time of the wall spacers, since more wall spacers can be carried at the same time. A stack of wall spacers is preferably packed as a packing unit comprising e.g. 50 wall spacers. Such a packing unit can easily be loaded onto a feeder device for a subsequent distribution of wall spacers on a mould surface. The feeder device may be a manually operated feeder device operated by a user, but may also be an automated or semi-automated feeder device running on wheels. When the wall spacers are used in an automated precast industry, the wall spacers may also be distributed by a robot. Robots are often used to lift and position the reinforcement grid, and can also be used to distribute the wall spacers. A handheld feeder device holds the stack of wall spacers on a central body where the release mechanism operates outwards from the body of the feeder device. The handheld feeder device preferably comprises a body which is elongated and may be a rod or a similar element. The outer shape of the body may be circular or may have another shape.

The invention is not to be regarded as being limited to the embodiments described above, a number of additional variants and modifications being possible within the scope of the subsequent patent claims. The wall spacer may be made from any suitable material. The size of the wall spacer is adapted to a mesh in a reinforcement grid, such that the size preferably is in the range of 10 to 30 cm. Other shapes are also possible.

REFERENCE SIGNS

1: Wall spacer
2: Body section
3: Upper support surface
4: Leg section
5: Foot
6: Void
7: Upper portion of leg section
8: Central opening
9: Inner rim
10: Outer circumference
11: Inner side wall
12: Outer side wall
13: Connection wall
14: Reinforcement wall
15: Outer rim
16: Ridge
17: Pin
18: Recess
19: Side wall of leg section
20: Reinforcement grid
21: Mesh
22: Stack of wall spacers
23: Vertical axis

The invention claimed is:

1. A stackable wall spacer (1) adapted to be distributed randomly on a mould surface for support of a reinforcement grid (20), the wall spacer (1) comprising:

a central opening (8) having a rim (9) configured to interact with a release mechanism operating outwards from the body of a feeder device to be used for distribution of the wall spacer; and a circumferential body section (2) having:

an upper support surface (3) which is flat and is situated in one plane and is adapted to support the reinforcement grid, at least one side wall (12, 11) spaced from the rim (9) and extending between the upper support surface (3) and a base of the body section (2), the base lying in another plane parallel to and spaced apart from the plane of the upper support surface (3), and a plurality of leg sections (4) each having side walls (19) spaced from the rim (9) and a foot (5) adapted to be placed on a mould surface for the concrete, wherein:

an outer shape of the circumferential body section (2) is larger than a mesh (21) in the reinforcement grid (20) that is to be supported;

each of the side walls (19) of each leg section (4) defines a continuous surface that extends from the upper support surface (3) to the foot (5), the continuous surface being inclined with respect to a vertical direction; and each leg section (4) is provided with a void (6) adapted to house a leg section (4) of another wall spacer (1), such that a plurality of wall spacers (1) can be stacked in each other with the leg sections (4) of one wall spacer (1) extending into the corresponding voids (6) of a subsequent wall spacer (1), such that each of the side walls (19) of each leg section (4) is parallel with the side wall (19) of each leg section (4) of the subsequent wall spacer (1).

2. A stackable wall spacer according to claim 1, wherein a leg section (4) extends into the void (6) of a subsequent wall spacer (1) with at least 30% of the height of the wall spacer.

3. A stackable wall spacer according to claim 1, wherein the side walls of each of the plurality of leg sections (4) is inclined with an angle between 3 and 25 degrees in relation to the vertical direction.

4. A stackable wall spacer according to claim 1, wherein the at least one side wall of the body section (2) comprises an outer wall (12) extending along the outer circumference (10) of the wall spacer (1).

5. A stackable wall spacer according to claim 4, wherein the at least one side wall of the body section (2) comprises an inner wall (11) arranged between the outer wall (12) and the central opening (8).

6. A stackable wall spacer according to claim 5, wherein the inner wall (11) and the outer wall (12) are interconnected by reinforcement walls (14).

7. A stackable wall spacer according to claim 1, wherein the outer shape of the wall spacer is quadratic.

8. A stackable wall spacer according to claim 1, wherein the outer shape of the wall spacer is circular.

9. A stackable wall spacer according to claim 1, wherein the outer shape of the wall spacer comprises three parts having a dividing angle of 120 degrees.

10. A stackable wall spacer according to claim 1, wherein each of the plurality of leg sections (4) is circular and conical.

11. A stackable wall spacer according to claim 1, wherein each of the plurality of leg sections (4) comprises at least two straight walls.

12. A stackable wall spacer according to claim 1, wherein each of the plurality of leg sections (4) comprises a plurality of feet (5).

13. A stackable wall spacer according to claim 1, wherein the rim (9) is interconnected with the body section (2) through connection walls (13).

14. A stackable wall spacer according to claim 1, wherein:

the wall spacer comprises a plurality of ridges (16) arranged at the upper portion (7) of the leg sections; and a ridge (16) is adapted to bear on the upper support surface (3) of another wall spacer when several wall spacers are stacked in each other.

15. A stackable wall spacer according to claim 1, wherein the wall spacer comprises a plurality of upward protruding pins (17) arranged at the upper support surface (3).

16. A stackable wall spacer (1) adapted to be distributed randomly on a mould surface for support of a reinforcement grid (20), the wall spacer (1) comprising:

a central opening (8) having a rim (9) configured to interact with a release mechanism operating outwards from the body of a feeder device to be used for distribution of the wall spacer; and a circumferential body section (2) having:

an upper support surface (3) which is flat and is situated in one plane and is adapted to support the reinforcement grid, a base lying in another plane parallel to and spaced apart from the plane of the upper support surface (3), and a plurality of leg sections (4) each having side walls (19) spaced from the rim (9) and a foot (5) adapted to be placed on a mould surface for the concrete, wherein:

the outer shape of the circumferential body section (2) is larger than a mesh (21) in the reinforcement grid (20) that is to be supported;

the foot (5) of each of the plurality of leg sections (4) lies in a plane parallel to and spaced apart from the planes of the upper support surface (3) and the base, such that the plane of the base is intermediate the planes of the upper support surface (3) and the foot (5);

each of the side walls (19) of each leg section (4) defines a continuous surface that extends from the upper support surface (3) to the foot (5), the continuous surface being inclined with respect to a vertical direction; and each leg section (4) is provided with a void (6) adapted to house a leg section (4) of another wall spacer (1), such that a plurality of wall spacers (1) can be stacked in each other with the leg sections (4) of one wall spacer (1) extending into the corresponding voids (6) of a subsequent wall spacer (1), such that each of the side walls (19) of each leg section (4) is parallel with the side wall (19) of each leg section (4) of the subsequent wall spacer (1).

* * * * *